US010677274B2

(12) United States Patent
Kondo et al.

(10) Patent No.: US 10,677,274 B2
(45) Date of Patent: Jun. 9, 2020

(54) HYDRAULIC EXCAVATOR DRIVE SYSTEM

(71) Applicant: KAWASAKI JUKOGYO KABUSHIKI KAISHA, Kobe-shi, Hyogo (JP)

(72) Inventors: Akihiro Kondo, Kobe (JP); Makoto Ito, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/473,227

(22) PCT Filed: Dec. 18, 2017

(86) PCT No.: PCT/JP2017/045349
§ 371 (c)(1),
(2) Date: Jun. 24, 2019

(87) PCT Pub. No.: WO2018/117029
PCT Pub. Date: Jun. 28, 2018

(65) Prior Publication Data

US 2019/0316611 A1 Oct. 17, 2019

(30) Foreign Application Priority Data

Dec. 22, 2016 (JP) ..... 2016-249462

(51) Int. Cl.
*F15B 21/14* (2006.01)
*E02F 9/22* (2006.01)

(52) U.S. Cl.
CPC ..... *F15B 21/14* (2013.01); *E02F 9/2217* (2013.01); *E02F 9/2292* (2013.01); *E02F 9/2296* (2013.01); *F15B 2211/88* (2013.01)

(58) Field of Classification Search
CPC ..... F15B 21/14; E02F 9/2217; E02F 9/2292; E02F 9/2296
See application file for complete search history.

(56) References Cited

U.S. PATENT DOCUMENTS

| | | | | |
|---|---|---|---|---|
| 9,394,671 | B2 * | 7/2016 | Hirozawa | E02F 9/2217 |
| 10,301,793 | B2 * | 5/2019 | Hijikata | F15B 21/14 |
| 10,344,458 | B2 * | 7/2019 | Hijikata | F15B 21/14 |
| 10,526,767 | B2 * | 1/2020 | Hijikata | F15B 21/14 |

FOREIGN PATENT DOCUMENTS

JP 4446851 B2 4/2010

* cited by examiner

*Primary Examiner* — Michael Leslie
(74) *Attorney, Agent, or Firm* — Oliff PLC

(57) ABSTRACT

A hydraulic excavator drive system includes: a boom cylinder; a boom first control valve connected to the boom cylinder by a boom raising supply line and a boom lowering supply line, and connected to a first pump by a first boom distribution line; a boom second control valve connected to the boom raising supply line by a boom replenishment line, and connected to a second pump by a second boom distribution line; an arm cylinder; an arm control valve connected to the arm cylinder by an arm crowding supply line and an arm pushing supply line, and connected to the second pump by an arm distribution line; a regenerative line connecting between the boom replenishment line and the arm distribution line; and an openable and closeable regenerative valve provided on the regenerative line.

7 Claims, 11 Drawing Sheets

HYDRAULIC EXCAVATOR DRIVE SYSTEM

TECHNICAL FIELD

The present invention relates to a hydraulic excavator drive system.

BACKGROUND ART

Generally speaking, a hydraulic excavator includes: a boom that is raised and lowered relative to a turning unit; an arm swingably coupled to the distal end of the boom; and a bucket swingably coupled to the distal end of the arm. A drive system installed in such a hydraulic excavator includes, for example, a boom cylinder driving the boom, an arm cylinder driving the arm, and a bucket cylinder driving the bucket. These hydraulic actuators are supplied with hydraulic oil from pumps via control valves.

For example, Patent Literature 1 discloses a hydraulic excavator drive system 100 as shown in FIG. 11. In the drive system 100, boom raising is performed by extension of boom cylinders 101 and 102, and arm pushing is performed by extension of an arm cylinder 103.

To be specific, the boom cylinder 101 and the boom cylinder 102 are connected to a boom first control valve 121 and a boom second control valve 122 by a boom raising supply line 123 and a boom lowering supply line 124. The arm cylinder 103 is connected to an arm first control valve 131 and an arm second control valve 132 by an arm pushing supply line 133 and an arm crowding supply line 134.

The boom first control valve 121 and the arm first control valve 131 are disposed on a first center bleed line 112, which extends from a first pump 111 to a tank. The boom second control valve 122 and the arm second control valve 132 are disposed on a second center bleed line 114, which extends from a second pump 113 to the tank.

At the time of boom lowering operation, the boom cylinders 101 and 102 are retracted by the weight of, for example, the boom. Therefore, at the time of boom lowering operation, it is desired to efficiently utilize the hydraulic oil discharged from the boom cylinders 101 and 102.

In this respect, in the drive system 100, the boom raising supply line 123 and the arm pushing supply line 133 are connected to each other by an acceleration line 140. The acceleration line 140 is provided with an acceleration valve 141. When a boom lowering operation and an arm pushing operation are performed concurrently, the acceleration valve 141 is opened, and thereby the operating speed of the arm cylinder 103 is increased.

CITATION LIST

Patent Literature

PTL 1: Japanese Patent No. 4446851

SUMMARY OF INVENTION

Technical Problem

As in the drive system 100 shown in FIG. 11, at the time of boom lowering operation, it may be desired to regenerate the potential energy of the boom in a manner to increase the operating speed of the arm cylinder 103 by utilizing the hydraulic oil discharged from the boom cylinders 101 and 102, or depending on the size of the excavator, it may be desired to regenerate the potential energy of the boom as energy for supplying the hydraulic oil to the arm cylinder 103.

In view of the above, an object of the present invention is to provide a hydraulic excavator drive system capable of regenerating the potential energy of the boom in a manner to increase the operating speed of the arm cylinder or regenerating the potential energy of the boom as energy for supplying the hydraulic oil to the arm cylinder.

Solution to Problem

In order to solve the above-described problems, a hydraulic excavator drive system of the present invention includes: a first pump; a second pump; a boom cylinder; a boom first control valve connected to the boom cylinder by a boom raising supply line and a boom lowering supply line, and connected to the first pump by a first boom distribution line, the boom first control valve bringing the boom raising supply line into communication with the first boom distribution line and bringing the boom lowering supply line into communication with a first tank line at a time of boom raising operation, the boom first control valve bringing the boom lowering supply line into communication with the first boom distribution line and blocking the boom raising supply line at a time of boom lowering operation; a boom second control valve connected to the boom raising supply line by a boom replenishment line, and connected to the second pump by a second boom distribution line, the boom second control valve bringing the boom replenishment line into communication with the second boom distribution line at the time of boom raising operation, the boom second control valve bringing the boom replenishment line into communication with a second tank line at the time of boom lowering operation; an arm cylinder; an arm control valve connected to the arm cylinder by an arm crowding supply line and an arm pushing supply line, and connected to the second pump by an arm distribution line in parallel to the boom second control valve; a regenerative line connecting between the boom replenishment line and the arm distribution line; an openable and closeable regenerative valve provided on the regenerative line; a check valve provided on the regenerative line, the check valve allowing a flow from the boom replenishment line toward the arm distribution line and preventing a reverse flow; a boom operation device including an operating lever that receives a boom raising operation and a boom lowering operation, the boom operation device outputting a boom operation signal corresponding to an inclination angle of the operating lever; an arm operation device including an operating lever that receives an arm crowding operation and an arm pushing operation, the arm operation device outputting an arm operation signal corresponding to an inclination angle of the operating lever; and a controller that opens the regenerative valve when a regenerative condition is satisfied, and closes the regenerative valve when the regenerative condition is not satisfied, the regenerative condition being that, in a case where the boom lowering operation is performed concurrently with the arm crowding operation or the arm pushing operation, the boom operation signal outputted from the boom operation device is greater than a first threshold, and the arm operation signal outputted from the arm operation device is greater than a second threshold.

According to the above configuration, at the time of boom lowering operation, the meter-in flow rate can be independently controlled by the boom first control valve, and also, the meter-out flow rate can be independently controlled by the boom second control valve. If the regenerative condition is satisfied when the boom lowering operation is performed concurrently with the arm crowding operation or the arm pushing operation, the regenerative valve is opened. Accordingly, if the discharge flow rate of the second pump is decreased, the potential energy of the boom can be regenerated as energy for supplying the hydraulic oil to the arm cylinder. On the other hand, if the discharge flow rate of the second pump is not decreased, the potential energy of the boom can be regenerated in a manner to increase the operating speed of the arm cylinder. In addition, since the regenerative line merges with the arm distribution line, energy regeneration can be performed both at the time of arm crowding operation and at the time of arm pushing operation.

For example, the second pump may be a variable displacement pump. The above hydraulic excavator drive system may further include a second flow rate adjuster that adjusts a tilting angle of the second pump. The controller may control the second flow rate adjuster, such that the tilting angle of the second pump increases in accordance with increase in the arm operation signal outputted from the arm operation device, and when the regenerative condition is satisfied, control the second flow rate adjuster such that the tilting angle of the second pump, the tilting angle corresponding to the arm operation signal outputted from the arm operation device, is reduced compared to a case where the arm crowding operation or the arm pushing operation is performed alone.

The above hydraulic excavator drive system may further include a solenoid proportional valve connected to a pilot port of the boom second control valve, the pilot port being intended for boom lowering. The controller may control the solenoid proportional valve, such that an opening area of the boom second control valve increases in accordance with increase in the boom operation signal outputted from the boom operation device, and when the regenerative condition is satisfied, control the solenoid proportional valve, such that the opening area of the boom second control valve is reduced compared to a case where the boom lowering operation is performed alone. According to this configuration, part of the hydraulic oil discharged from the boom cylinder (the part corresponding to the reduction in the opening area of the boom second control valve) can be actively flowed into the regenerative line.

The regenerative valve may be a valve whose opening degree is arbitrarily changeable. In this case, the above hydraulic excavator drive system may further include: an upstream-side pressure sensor that detects a pressure in the regenerative line at a position that is closer to the boom replenishment line than the regenerative valve; and a second pump pressure sensor that detects a discharge pressure of the second pump. When the regenerative condition is satisfied, the controller may adjust the opening degree of the regenerative valve based on the pressure detected by the upstream-side pressure sensor and the pressure detected by the second pump pressure sensor. According to this configuration, the amount of energy that can be regenerated can be increased compared to a case where the regenerative valve is an on-off valve.

Alternatively, the above hydraulic excavator drive system may further include: an upstream-side pressure sensor that detects a pressure in the regenerative line at a position that is closer to the boom replenishment line than the regenerative valve; and a downstream-side pressure sensor that detects a pressure in the regenerative line at a position that is closer to the arm distribution line than the regenerative valve. When the regenerative condition is satisfied, the controller may adjust the opening degree of the regenerative valve based on the pressure detected by the upstream-side pressure sensor and the pressure detected by the downstream-side pressure sensor. According to this configuration, the amount of energy that can be regenerated can be further increased compared to a case where the regenerative valve is an on-off valve.

The first pump may be a variable displacement pump. The above hydraulic excavator drive system may further include: a first flow rate adjuster that adjusts a tilting angle of the first pump; and a make-up line provided with a check valve, the make-up line connecting between the boom lowering supply line and a tank. The controller may control the first flow rate adjuster, such that the tilting angle of the first pump increases in accordance with increase in the boom operation signal outputted from the boom operation device, and when the regenerative condition is satisfied, control the first flow rate adjuster such that the tilting angle of the first pump, the tilting angle corresponding to the boom operation signal outputted from the boom operation device, is reduced compared to a case where the boom lowering operation is performed alone. According to this configuration, when the regenerative condition is satisfied, the discharge flow rate of the first pump is kept low. Even if the discharge flow rate of the first pump, which is thus kept low, is insufficient to achieve a required amount of hydraulic oil flowing into the boom cylinder, the shortfall amount of hydraulic oil is supplied to the boom cylinder through the make-up line. Thus, energy consumption can be reduced by an amount corresponding to the lowering of the discharge flow rate of the first pump.

Advantageous Effects of Invention

The present invention makes it possible to regenerate the potential energy of the boom in a manner to increase the operating speed of the arm cylinder or regenerate the potential energy of the boom as energy for supplying the hydraulic oil to the arm cylinder.

BRIEF DESCRIPTION OF DRAWINGS

FIG. 5A shows a relationship, at the time of boom lowering operation, between the inclination angle (boom operation signal) of an operating lever of a boom operation device and a meter-out flow rate passing through a boom second control valve; FIG. 5B shows a relationship between the inclination angle (arm operation signal) of an operating lever of an arm operation device and a meter-in flow rate passing through an arm control valve; and FIG. 5C shows a relationship between the inclination angle of the operating lever of the arm operation device and the discharge flow rate of a second main pump.

FIG. 9A shows a relationship, at the time of boom lowering operation, between the inclination angle (boom operation signal) of the operating lever of the boom operation device and the meter-out flow rate passing through the boom second control valve; FIG. 9B shows a relationship between the inclination angle (arm operation signal) of the operating lever of the arm operation device and the meter-in flow rate passing through the arm control valve; and FIG. 9C shows a relationship between the inclination angle of the operating lever of the arm operation device and the discharge flow rate of the second main pump.

DESCRIPTION OF EMBODIMENTS

Embodiment 1

Figure 1:
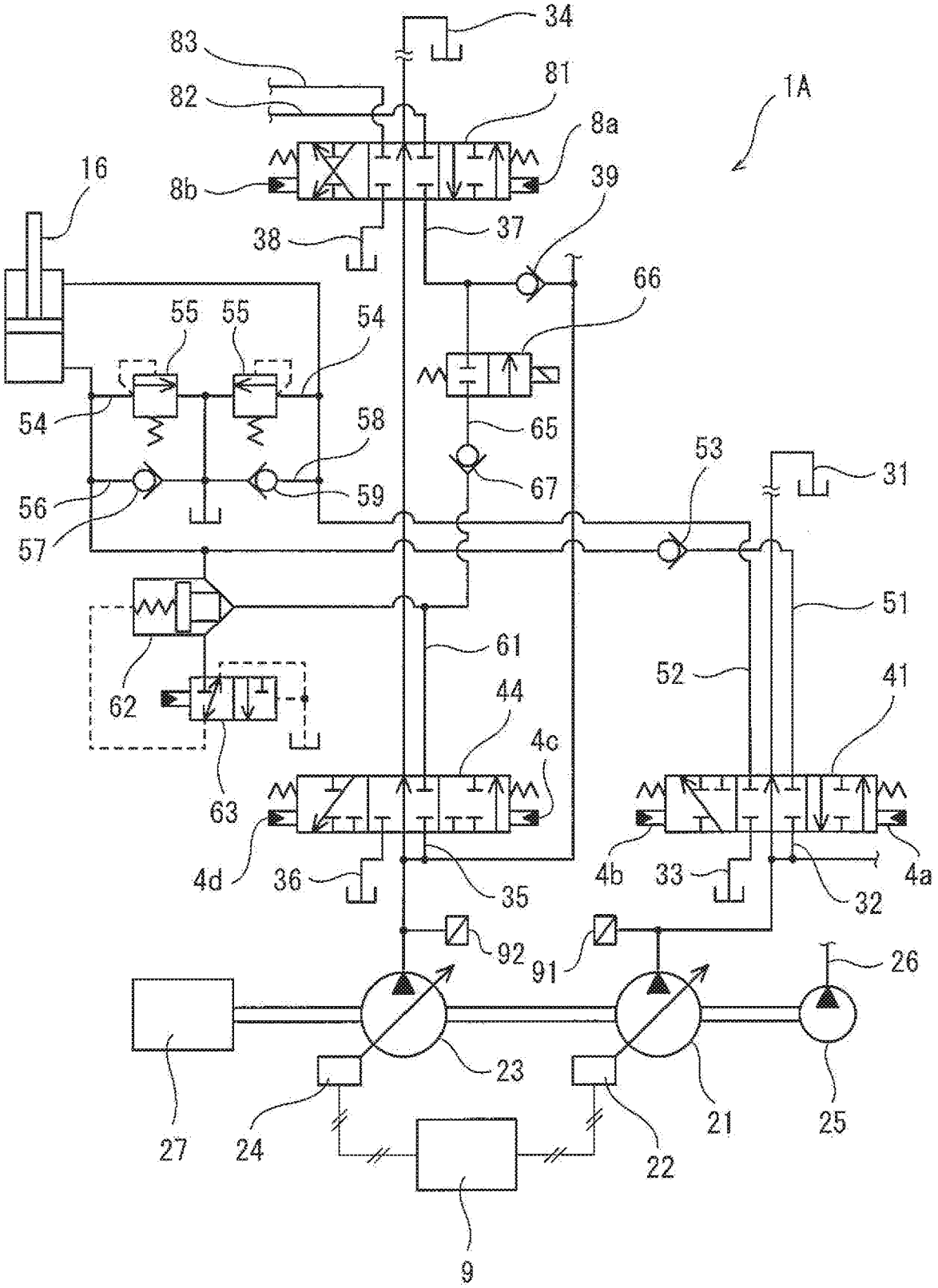
FIG. 1 is a main circuit diagram of a hydraulic excavator drive system according to Embodiment 1 of the present invention.
Figure 2:
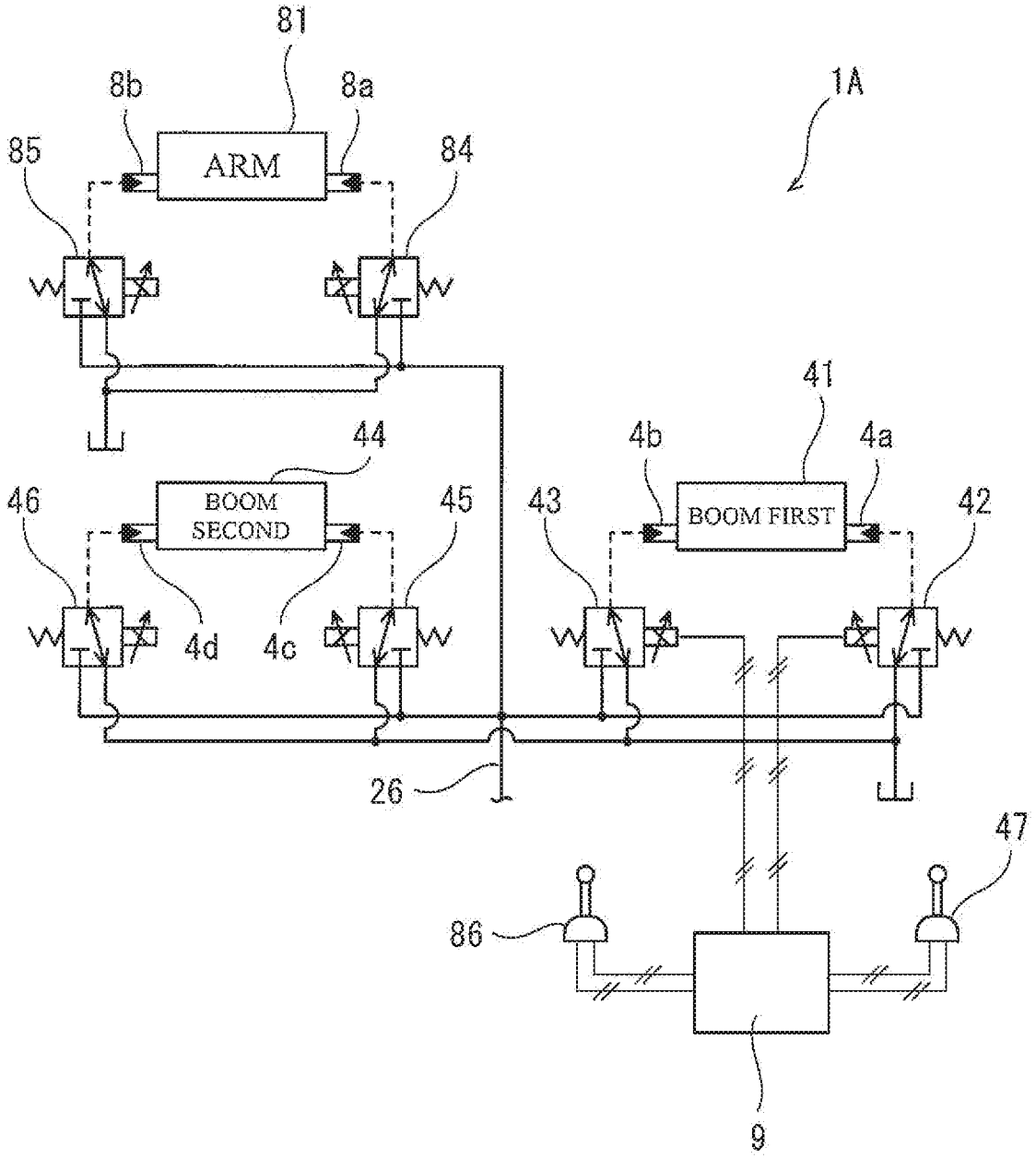
FIG. 2 is an operation-related circuit diagram of the hydraulic drive system of FIG. 1.
Figure 3:
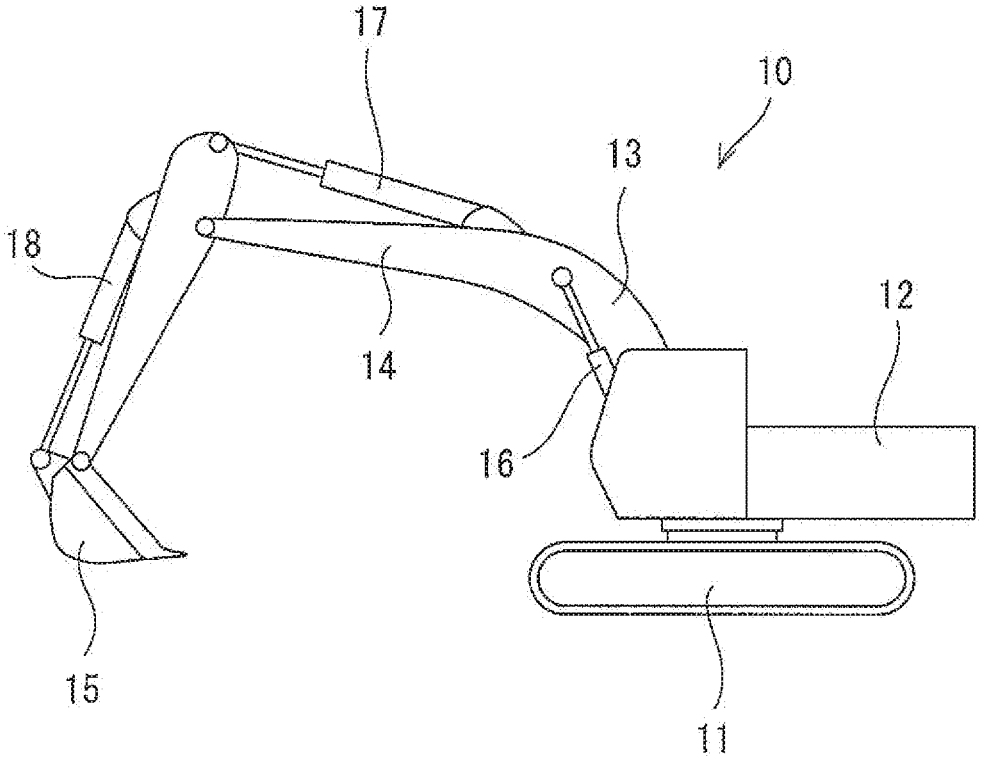
FIG. 3 is a side view of a hydraulic excavator.

FIG. 1 and FIG. 2 show a hydraulic excavator drive system 1A according to Embodiment 1 of the present invention. FIG. 3 shows a hydraulic excavator 10, in which the drive system 1A is installed.

The hydraulic excavator 10 shown in FIG. 3 includes a running unit 11 and a turning unit 12. The hydraulic excavator 10 further includes: a boom 13, which is raised and lowered relative to the turning unit 12; an arm 14 swingably coupled to the distal end of the boom 13; and a bucket 15 swingably coupled to the distal end of the arm 14. However, the hydraulic excavator 10 need not include the running unit 11. In such a case, for example, the hydraulic excavator 10 may be installed on a ship, or the hydraulic excavator 10 may be installed at a port as a loader or an unloader.

The drive system 1A includes, as hydraulic actuators, a pair of right and left running motors and a turning motor (which are not shown), a boom cylinder 16, an arm cylinder 17, and a bucket cylinder 18. The boom cylinder 16 drives the boom 13. The arm cylinder 17 drives the arm 14. The bucket cylinder 18 drives the bucket 15. In the present embodiment, arm pushing is performed by retraction of the arm cylinder 17. However, as an alternative, arm pushing may be performed by extension of the arm cylinder 17.

As shown in FIG. 1, the drive system 1A further includes a first main pump 21 and a second main pump 23, which supply hydraulic oil to the above hydraulic actuators. The first main pump 21 and the second main pump 23 are driven by an engine 27. The engine 27 also drives an auxiliary pump 25.

The first main pump 21 and the second main pump 23 are variable displacement pumps, each of which discharges the hydraulic oil at a flow rate corresponding to the tilting angle of the pump. The discharge pressure Pd1 of the first main pump 21 is detected by a first pump pressure sensor 91, and the discharge pressure Pd2 of the second main pump 23 is detected by a second pump pressure sensor 92. In the present embodiment, the first main pump 21 and the second main pump 23 are each a swash plate pump, the tilting angle of which is defined by a swash plate angle. However, as an alternative, the first main pump 21 and the second main pump 23 may each be a bent axis pump, the tilting angle of which is defined by a bent axis angle.

The discharge flow rate Q1 of the first main pump 21 and the discharge flow rate Q2 of the second main pump 23 are controlled by electrical positive control. To be specific, the tilting angle of the first main pump 21 is adjusted by a first flow rate adjuster 22, and the tilting angle of the second main pump 23 is adjusted by a second flow rate adjuster 24. The first flow rate adjuster 22 and the second flow rate adjuster 24 will be described below in detail.

The aforementioned boom cylinder 16 is supplied with the hydraulic oil from the first main pump 21 via a boom first control valve 41, and also, supplied with the hydraulic oil from the second main pump 23 via a boom second control valve 44. The arm cylinder 17 is supplied with the hydraulic oil from the second main pump 23 via an arm control valve 81. Although not illustrated, the arm control valve 81 may be an arm first control valve, and the arm cylinder 17 may be supplied with the hydraulic oil also from the first main pump 21 via an arm second control valve. It should be noted that the other control valves intended for hydraulic actuators are not shown in FIG. 1.

To be specific, a first center bleed line 31 extends from the first main pump 21 to a tank, and a second center bleed line 34 extends from the second main pump 23 to the tank. The boom first control valve 41 is disposed on the first center bleed line 31, and the boom second control valve 44 and the arm control valve 81 are disposed on the second center bleed line 34. Although not illustrated as mentioned above, for example, a control valve intended for the turning motor is disposed on the first center bleed line 31, and also, for example, a control valve intended for the bucket cylinder 18 is disposed on the second center bleed line 34.

The boom first control valve 41 is connected to the first main pump 21 by a first boom distribution line 32, and connected to the tank by a tank line 33 (corresponding to a first tank line of the present invention). The boom first control valve 41 is further connected to the boom cylinder 16 by a boom raising supply line 51 and a boom lowering supply line 52.

At the time of boom raising operation, the boom first control valve 41 brings the boom raising supply line 51 into communication with the first boom distribution line 32, and brings the boom lowering supply line 52 into communication with the tank line 33. On the other hand, at the time of boom lowering operation, the boom first control valve 41 brings the boom lowering supply line 52 into communication with the first boom distribution line 32, and blocks the boom raising supply line 51.

The boom second control valve 44 is connected to the second main pump 23 by a second boom distribution line 35, and connected to the tank by a tank line 36 (corresponding to a second tank line of the present invention). The boom second control valve 44 is further connected to the boom raising supply line 51 by a boom replenishment line 61. The boom second control valve 44 brings the boom replenishment line 61 into communication with the second boom distribution line 35 at the time of boom raising operation, and brings the boom replenishment line 61 into communication with the tank line 36 at the time of boom lowering operation.

The boom raising supply line 51 is provided with a check valve 53 positioned between the boom first control valve 41 and a merging point where the boom raising supply line 51 merges with the boom replenishment line 61. The check valve 53 allows a flow from the boom first control valve 41 toward the boom cylinder 16, and prevents the reverse flow.

The boom replenishment line 61 is provided with a lock valve 62 for preventing retraction of the boom cylinder 16 due to gravitational force. The lock valve 62 prevents the hydraulic oil from flowing through the boom replenishment line 61 when a switching valve 63 is positioned at a locking position (left-side position in FIG. 1), and allows the hydraulic oil to flow through the boom replenishment line 61 when the switching valve 63 is positioned at a non-locking position (right-side position in FIG. 1). The switching valve 63 is configured such that the switching valve 63 is normally positioned at the locking position, and moves to the non-locking position at the time of boom raising operation and at the time of boom lowering operation.

A relief line 54 branches off from each of the boom raising supply line 51 and the boom lowering supply line 52, and the relief lines 54 connect to the tank. Each relief line 54 is provided with a relief valve 55. The boom raising supply line 51 is connected to the tank by a make-up line 56, and the boom lowering supply line 52 is connected to the tank by a make-up line 58. The make-up lines 56 and 58 are provided with check valves 57 and 59, respectively. Each of the check valves 57 and 59 allows a flow toward the supply line (51 or 52), and prevents the reverse flow.

The arm control valve 81 is connected to the second main pump 23 by an arm distribution line 37, and connected to the tank by a tank line 38. In other words, the arm control valve 81 is connected to the second main pump 23 by the arm distribution line 37 in parallel to the boom second control valve 44. The arm control valve 81 is further connected to the arm cylinder 17 (not shown in FIG. 1) by an arm crowding supply line 82 and an arm pushing supply line 83. At the time of arm crowding operation, the arm control valve 81 brings the arm crowding supply line 82 into communication with the arm distribution line 37, and brings the arm pushing supply line 83 into communication with the tank line 38. On the other hand, at the time of arm pushing operation, the arm control valve 81 brings the arm pushing supply line 83 into communication with the arm distribution line 37, and brings the arm crowding supply line 82 into communication with the tank line 38.

The boom replenishment line 61 and the arm distribution line 37 are connected to each other by a regenerative line 65. To be more specific, the regenerative line 65 branches off from the boom replenishment line 61 at a position between the boom second control valve 44 and the lock valve 62, and merges with the arm distribution line 37. The arm distribution line 37 is provided with a check valve 39, which is positioned upstream of a merging point where the regenerative line 65 merges with the arm distribution line 37.

The regenerative line 65 is provided with a regenerative valve 66, which is openable and closeable. In the present embodiment, the regenerative valve 66 is a solenoid on-off valve. The regenerative line 65 is provided with a check valve 67, which allows a flow from the boom replenishment line 61 toward the arm distribution line 37, and prevents the reverse flow. In the illustrated example, the check valve 67 is provided at a position between the regenerative valve 66 and the boom replenishment line 61. However, as an alternative, the check valve 67 may be provided at a position between the regenerative valve 66 and the arm distribution line 37.

As shown in FIG. 2, the above-described boom first control valve 41 and boom second control valve 44 are operated by a boom operation device 47, and the arm control valve 81 is operated by an arm operation device 86. The boom operation device 47 includes an operating lever that receives a boom raising operation and a boom lowering operation, and outputs a boom operation signal corresponding to an inclination angle of the operating lever. The arm operation device 86 includes an operating lever that receives an arm crowding operation and an arm pushing operation, and outputs an arm operation signal corresponding to an inclination angle of the operating lever.

In the present embodiment, each of the boom operation device 47 and the arm operation device 86 is an electrical joystick that outputs, as an operation signal (i.e., the boom operation signal or the arm operation signal), an electrical signal corresponding to the inclination angle of the operating lever. The electrical signals outputted from the boom operation device 47 and the arm operation device 86 are inputted to a controller 9. For example, the controller 9 is a computer including a CPU and memories such as a ROM and RAM. The CPU executes a program stored in the ROM.

The boom first control valve 41 includes a first pilot port 4*a* intended for boom raising operation and a second pilot port 4*b* intended for boom lowering operation. The first pilot port 4*a* and the second pilot port 4*b* are connected to a pair of solenoid proportional valves 42 and 43, respectively, by pilot lines.

The boom second control valve 44 includes a first pilot port 4*c* intended for boom raising operation and a second pilot port 4*d* intended for boom lowering operation. The first pilot port 4*c* and the second pilot port 4*d* are connected to a pair of solenoid proportional valves 45 and 46, respectively, by pilot lines.

The arm control valve 81 includes a first pilot port 8*a* intended for arm crowding operation and a second pilot port 8*b* intended for arm pushing operation. The first pilot port 8*a* and the second pilot port 8*b* are connected to a pair of solenoid proportional valves 84 and 85, respectively, by pilot lines.

The solenoid proportional valves 42, 43, 45, 46, 84, and 85 are connected to the aforementioned auxiliary pump 25 by a primary pressure line 26. In the present embodiment, each of the solenoid proportional valves 42, 43, 45, 46, 84, and 85 is a direct proportional valve (normally closed valve) that outputs a secondary pressure that increases in accordance with increase in a command current. However, as an alternative, each of the solenoid proportional valves 42, 43, 45, 46, 84, and 85 may be an inverse proportional valve (normally open valve) that outputs a secondary pressure that decreases in accordance with increase in the command current.

The controller 9 controls the solenoid proportional valves 42 and 43 intended for the boom first control valve 41 and the solenoid proportional valves 45 and 46 intended for the boom second control valve 44, such that the opening area of the boom first control valve 41 and the opening area of the boom second control valve 44 increase in accordance with increase in the boom operation signal outputted from the boom operation device 47. The controller 9 also controls the solenoid proportional valves 84 and 85 intended for the arm control valve 81, such that the opening area of the arm control valve 81 increases in accordance with increase in the arm operation signal outputted from the arm operation device 86.

The controller 9 further controls the aforementioned first flow rate adjuster 22 and second flow rate adjuster 24. To be specific, the controller 9 controls the first flow rate adjuster 22 and the second flow rate adjuster 24, such that the tilting angle of the first main pump 21 and the tilting angle of the second main pump 23 increase in accordance with increase in the boom operation signal outputted from the boom operation device 47. Also, the controller 9 controls the second flow rate adjuster 24, such that the tilting angle of the second main pump 23 increases in accordance with increase in the arm operation signal outputted from the arm operation device 86.

Figure 4:
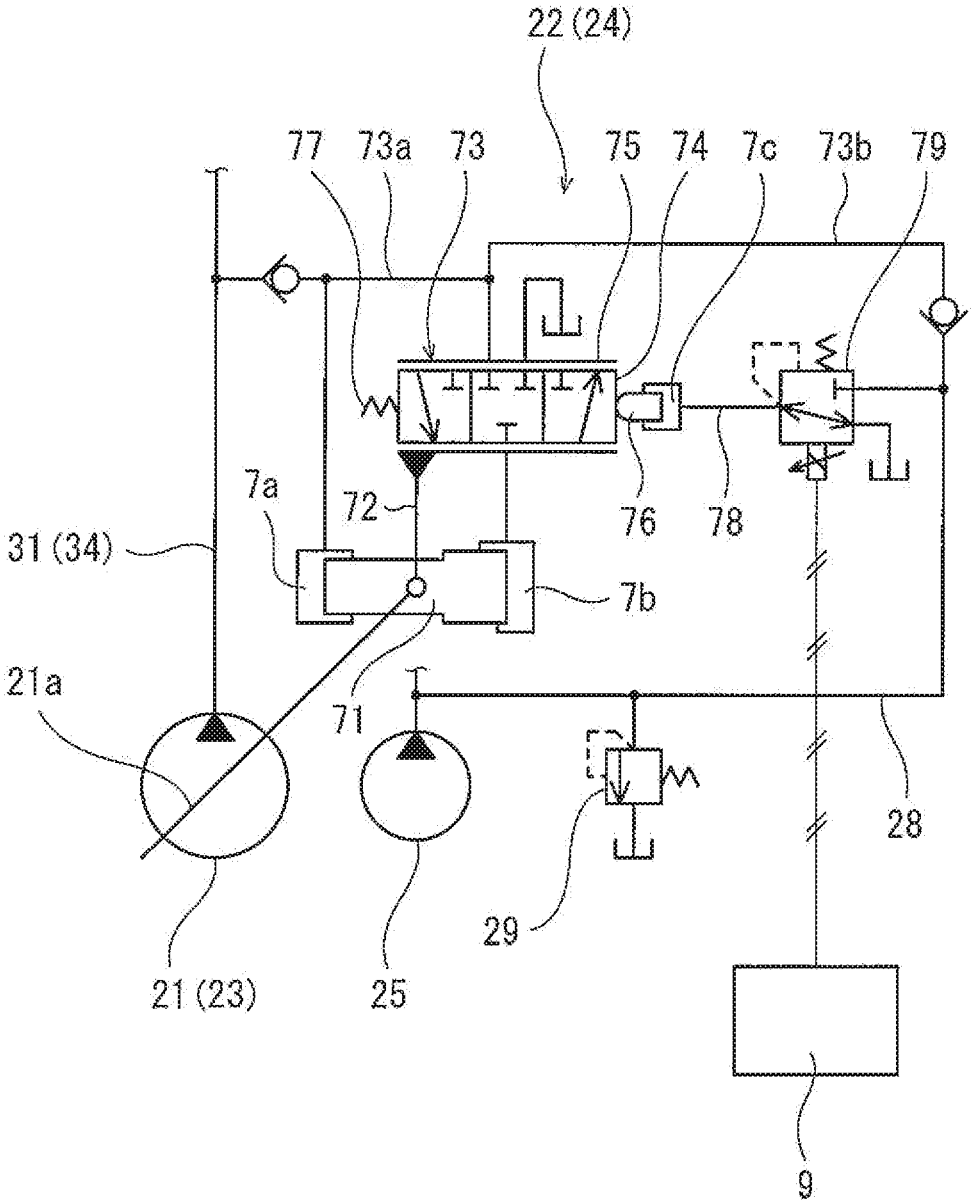
FIG. 4 shows a schematic configuration of a flow rate adjuster.

The first flow rate adjuster 22 and the second flow rate adjuster 24 have the same structure. For this reason, in the description below, the structure of the first flow rate adjuster 22 is described as a representative example with reference to FIG. 4.

The first flow rate adjuster 22 includes a servo piston 71 and an adjustment valve 73. The servo piston 71 changes the tilting angle of the first main pump 21, and the adjustment valve 73 is intended for driving the servo piston 71. In the first flow rate adjuster 22, a first pressure receiving chamber 7*a* and a second pressure receiving chamber 7*b* are formed. The discharge pressure Pd of the first main pump 21 is led into the first pressure receiving chamber 7*a*, and a control pressure Pc is led into the second pressure receiving chamber 7*b*. The servo piston 71 includes a first end portion and a second end portion. The second end portion has a greater diameter than that of the first end portion. The first end portion is exposed in the first pressure receiving chamber 7*a*, and the second end portion is exposed in the second pressure receiving chamber 7*b*.

The adjustment valve 73 is intended for adjusting the control pressure Pc led into the second pressure receiving chamber 7*b*. To be specific, the adjustment valve 73 includes a spool 74 and a sleeve 75. The spool 74 moves in a flow rate decreasing direction (in FIG. 4, to the right) to increase the control pressure Pc, and also moves in a flow rate increasing direction (in FIG. 1, to the left) to decrease the control pressure Pc. The sleeve 75 accommodates the spool 74 therein.

The servo piston 71 is coupled to a swash plate 21*a* of the first main pump 21, such that the servo piston 71 is movable in its axial direction. The sleeve 75 is coupled to the servo piston 71 by a feedback lever 72, such that the sleeve 75 is movable in the axial direction of the servo piston 71. In the sleeve 75, a pump port, a tank port, and an output port are formed (the output port communicates with the second pressure receiving chamber 7*b*). The output port is blocked from the pump port and the tank port, or communicates with the pump port or the tank port, in accordance with the positions of the sleeve 75 and the spool 74 relative to each other. When a flow rate adjusting piston 76, which will be described below, moves the spool 74 in the flow rate decreasing direction or the flow rate increasing direction, the spool 74 and the sleeve 75 are brought to positions relative to each other such that forces applied from both sides of the servo piston 71 (each force=pressure×pressure receiving area of the servo piston) are balanced, and thereby the control pressure Pc is adjusted.

The first flow rate adjuster 22 further includes the flow rate adjusting piston 76 and a spring 77. The flow rate adjusting piston 76 is intended for driving the spool 74. The spring 77 is disposed opposite to the flow rate adjusting piston 76, with the spool 74 being positioned between the spring 77 and the flow rate adjusting piston 76. The spool 74 is pressed by the flow rate adjusting piston 76 to move in the flow rate increasing direction, and is moved by the urging force of the spring 77 in the flow rate decreasing direction.

Further, an actuating chamber 7*c*, which applies a signal pressure Pp to the flow rate adjusting piston 76, is formed in the first flow rate adjuster 22. That is, the higher the signal pressure Pp, the more the flow rate adjusting piston 76 moves the spool 74 in the flow rate increasing direction. In other words, the flow rate adjusting piston 76 operates the servo piston 71 via the spool 74, such that the tilting angle of the first main pump 21 increases in accordance with increase in the signal pressure Pp.

The first flow rate adjuster 22 further includes a solenoid proportional valve 79, which is connected to the actuating chamber 7*c* by a signal pressure line 78. The solenoid proportional valve 79 is connected to the aforementioned auxiliary pump 25 by a primary pressure line 28. A relief line branches off from the primary pressure line 28, and the relief line is provided with a relief valve 29. It should be noted that, in the present embodiment, the primary pressure line 28 is connected to a supply line 73*a* by a relay line 73*b*. The supply line 73*a* brings the pump port of the sleeve 75 into communication with the first center bleed line 31.

The solenoid proportional valve 79 is fed with a command current from the controller 9. The solenoid proportional valve 79 is a direct-proportional valve (normally closed valve) that outputs a secondary pressure that increases in accordance with increase in the command current. The solenoid proportional valve 79 outputs the secondary pressure, which corresponds to the command current, as the aforementioned signal pressure Pp.

Next, control performed by the controller 9 is described in detail.

First, the controller 9 determines whether or not a regenerative condition has been satisfied. The regenerative condition is that, in a case where a boom lowering operation is performed concurrently with an arm crowding operation or an arm pushing operation, the boom operation signal outputted from the boom operation device 47 is greater than a first threshold $\alpha$, and also, the arm operation signal outputted from the arm operation device 86 is greater than a second threshold $\beta$.

The first threshold $\alpha$ and the second threshold $\beta$ can be arbitrarily set within such a range that the inclination angles of the operating levers of the boom operation device 47 and the arm operation device 86 are maximized or nearly maximized (i.e., the boom second control valve 44 and the arm control valve 81 reach a full stroke or nearly full stroke) and thereby a regenerative flow rate is expected to be obtained.

When the regenerative condition is not satisfied, the controller 9 closes the regenerative valve 66 even in a case where a boom lowering operation is performed concurrently with an arm crowding operation or an arm pushing operation. Also, when the regenerative condition is not satisfied, the controller 9 controls the solenoid proportional valve 46 of the boom second control valve 44 in the same manner as in a case where a boom lowering operation is performed alone.

Figure 5A:
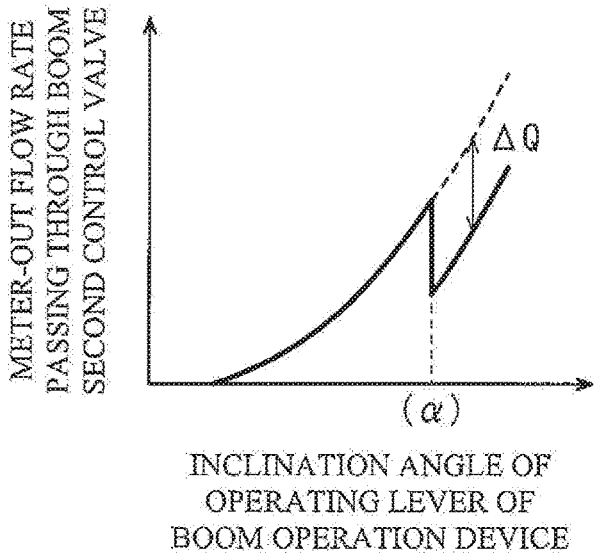
FIGS. 5A to 5C are graphs of Embodiment 1.
Figure 5B:
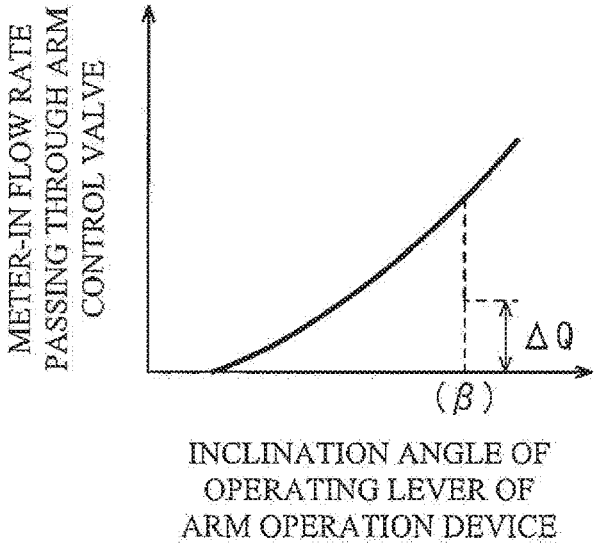

On the other hand, when the regenerative condition is satisfied, the controller 9 controls the solenoid proportional valve 46, such that the opening area of the boom second control valve 44 is reduced compared to a case where a boom lowering operation is performed alone. As a result, as shown in FIG. 5A, the passing flow rate of the boom second control valve 44 is decreased, by $\Delta Q$, compared to a case where a boom lowering operation is performed alone. Also, when the regenerative condition is satisfied, the controller 9 opens the regenerative valve 66. As a result, hydraulic oil at a flow rate corresponding to $\Delta Q$ is supplied to the arm distribution line 37 through the regenerative line 65 (see FIG. 5B).

Figure 5C:
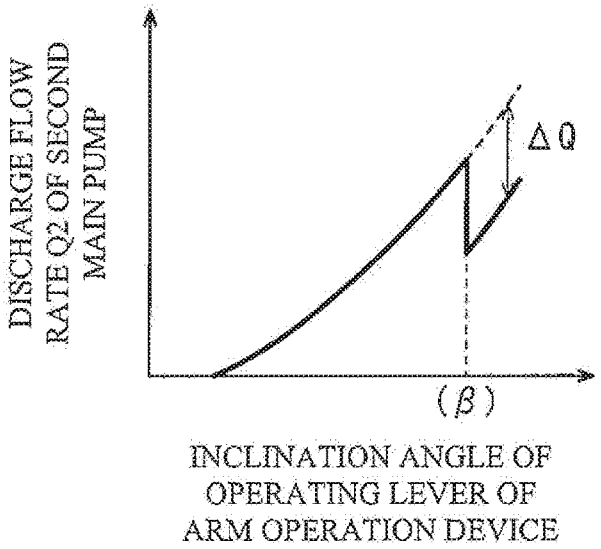

Further, when the regenerative condition is satisfied, as shown in FIG. 5C, the controller 9 controls the second flow rate adjuster 24 such that the tilting angle of the second main pump 23, the tilting angle corresponding to the arm operation signal outputted from the arm operation device 86, is reduced, by a value corresponding to ΔQ, compared to a case where an arm crowding operation or an arm pushing operation is performed alone.

In the drive system 1A with the above-described configuration, at the time of boom lowering operation, the meter-in flow rate can be independently controlled by the boom first control valve 41, and also, the meter-out flow rate can be independently controlled by the boom second control valve 44. If the regenerative condition is satisfied when a boom lowering operation is performed concurrently with an arm crowding operation or an arm pushing operation, the regenerative valve 66 is opened, and also, the discharge flow rate Q2 of the second main pump 23 is decreased. Accordingly, the potential energy of the boom can be regenerated as energy for supplying the hydraulic oil to the arm cylinder 17. In addition, since the regenerative line 65 merges with the arm distribution line 37, energy regeneration can be performed both at the time of arm crowding operation and at the time of arm pushing operation.

Further, in the present embodiment, when the regenerative condition is satisfied, the opening area of the boom second control valve 44 is reduced compared to a case where a boom lowering operation is performed alone. Accordingly, part of the hydraulic oil discharged from the boom cylinder 16 (the part corresponding to the reduction in the opening area of the boom second control valve 44) can be actively flowed into the regenerative line 65.

Still further, in the present embodiment, when the regenerative condition is satisfied, the controller 9 controls the first flow rate adjuster 22 such that the tilting angle of the first main pump 21, the tilting angle corresponding to the boom operation signal outputted from the boom operation device 47, is reduced compared to a case where a boom crowding operation is performed alone. According to this configuration, when the regenerative condition is satisfied, the discharge flow rate Q1 of the first main pump 21 is kept low. Even if the discharge flow rate Q1 of the first main pump 21, which is thus kept low, is insufficient to achieve a required amount of hydraulic oil flowing into the boom cylinder 16, the shortfall amount of hydraulic oil is supplied to the boom cylinder 16 through the make-up line 58. Thus, energy consumption can be reduced by an amount corresponding to the lowering of the discharge flow rate Q1 of the first main pump 21.

<Variations>

Figure 6A:
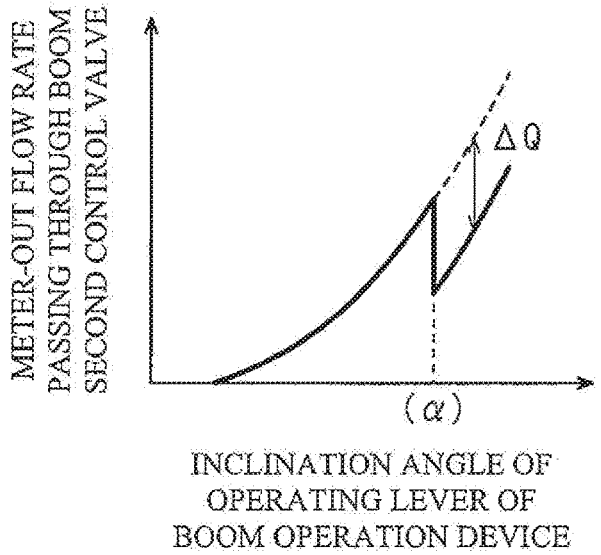
FIGS. 6A to 6C are graphs corresponding to FIGS. 5A to 5C, respectively, in a case where the discharge flow rate of the second main pump is not decreased.
Figure 6B:
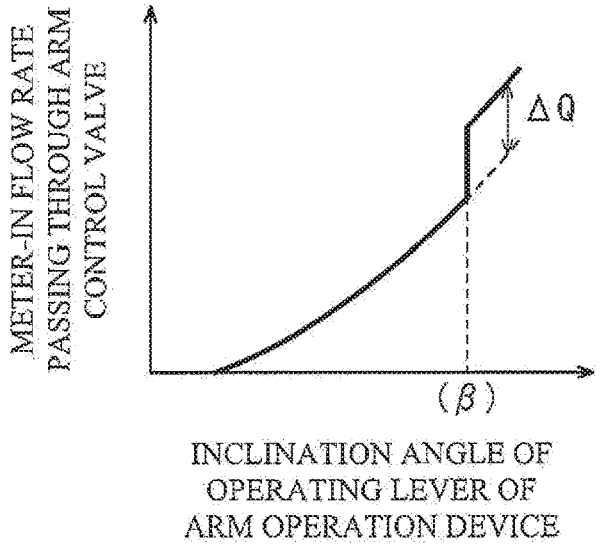
Figure 6C:
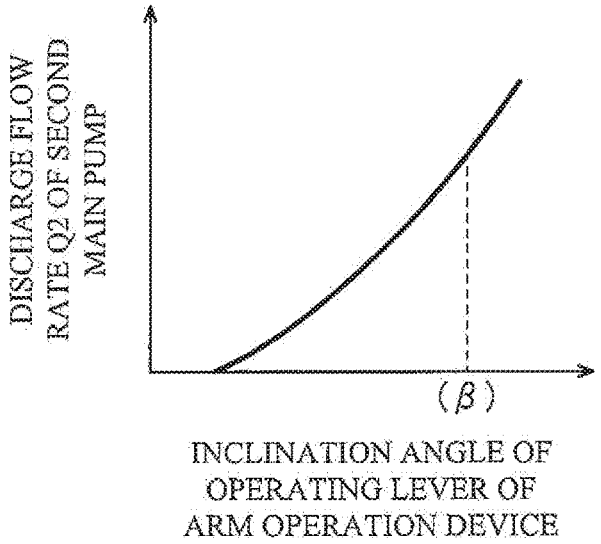

In the above-described embodiment, if the regenerative condition is satisfied when a boom lowering operation is performed concurrently with an arm crowding operation or an arm pushing operation, the regenerative valve 66 is opened, and also, the discharge flow rate Q2 of the second main pump 23 is decreased. However, as an alternative, when the regenerative condition is satisfied, as shown in FIGS. 6A to 6C, the discharge flow rate of the second main pump 23 need not be decreased. In such a case, the potential energy of the boom can be regenerated in a manner to increase the operating speed of the arm cylinder 17.

Figure 7:
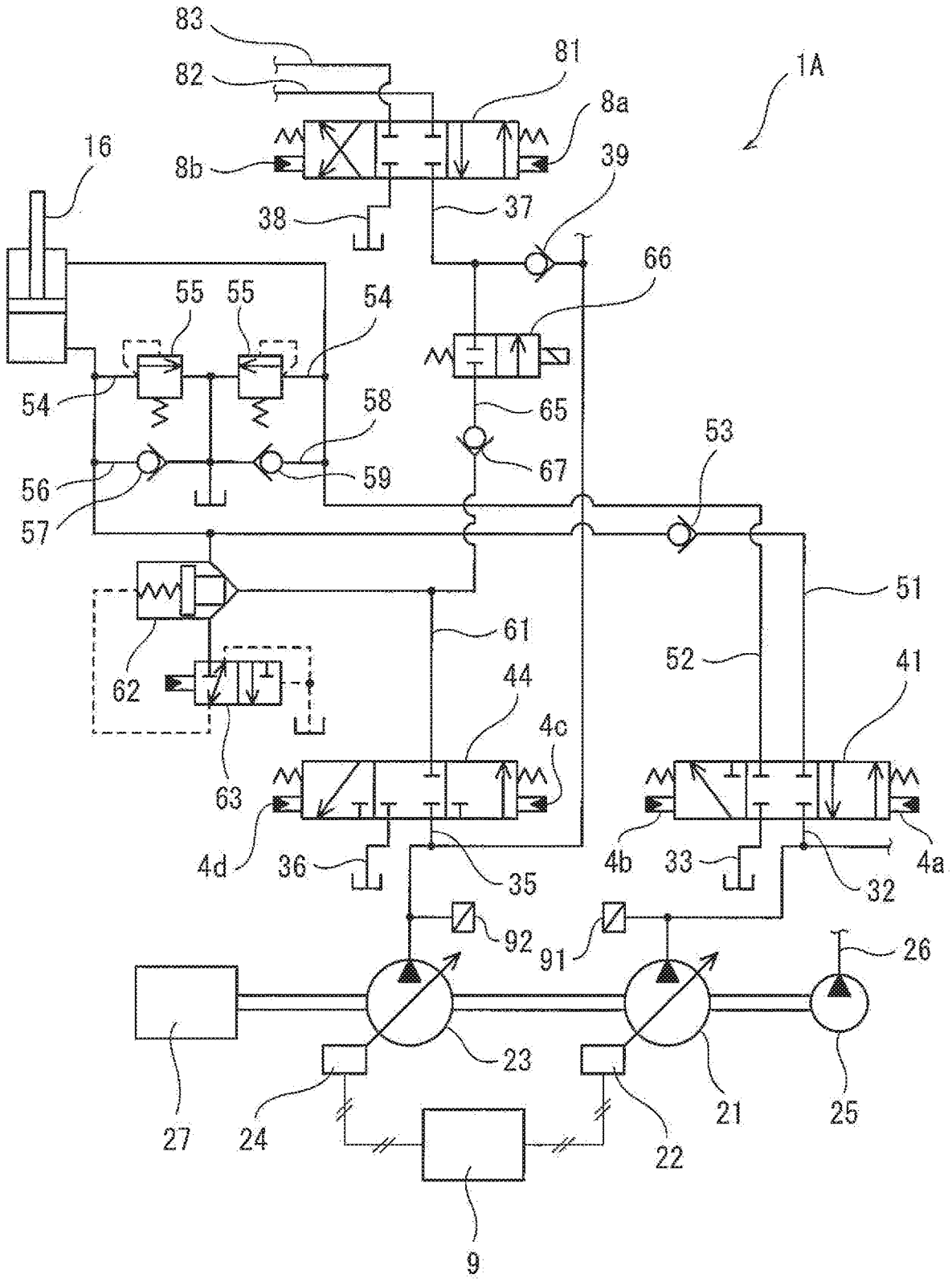
FIG. 7 is a main circuit diagram of the hydraulic excavator drive system according to a variation.

As shown in FIG. 7, the first center bleed line 31 and the second center bleed line 34 can be eliminated. This variation is applicable also to Embodiments 2 and 3 described below.

Embodiment 2

Figure 8:
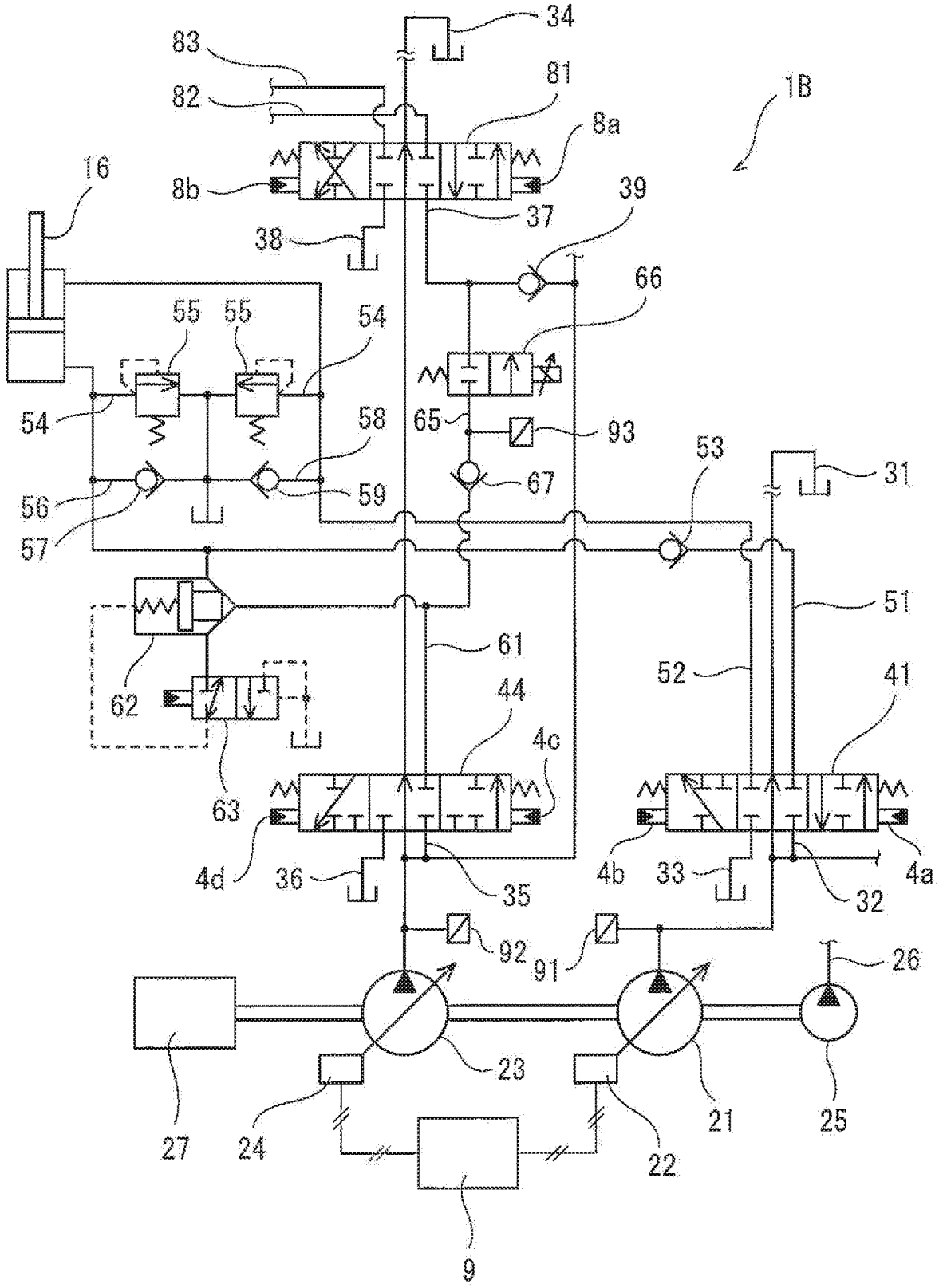
FIG. 8 is a main circuit diagram of a hydraulic excavator drive system according to Embodiment 2 of the present invention.

FIG. 8 shows a hydraulic excavator drive system 1B according to Embodiment 2 of the present invention. It should be noted that, in the present embodiment and the following Embodiment 3, the same components as those described in Embodiment 1 are denoted by the same reference signs as those used in Embodiment 1, and repeating the same descriptions is avoided.

In the present embodiment, the regenerative valve 66 is a solenoid valve whose opening degree is arbitrarily changeable (i.e., a variable restrictor). In addition, the present embodiment adopts an upstream-side pressure sensor 93, which detects a pressure PS1 in the regenerative line 65 at a position that is closer to the boom replenishment line 61 than the regenerative valve 66. The upstream-side pressure sensor 93 may be provided on the regenerative line 65 at a position between the regenerative valve 66 and the boom replenishment line 61, or may be provided on the boom replenishment line 61 at a position between the lock valve 62 and the boom second control valve 44.

When the regenerative condition is satisfied, the controller 9 adjusts the opening degree A of the regenerative valve 66 based on the pressure Pd2 detected by the second pump pressure sensor 92 and the pressure PSI detected by the upstream-side pressure sensor 93. To be specific, the opening degree A of the regenerative valve 66 is adjusted so as to satisfy the following relationship: $A=\Delta Q/c/\sqrt{(PS1-Pd2)}$. (Wherein ΔQ is a decrease in the passing flow rate of the boom second control valve 44, and c is a proportionality constant.)

Figure 9A:
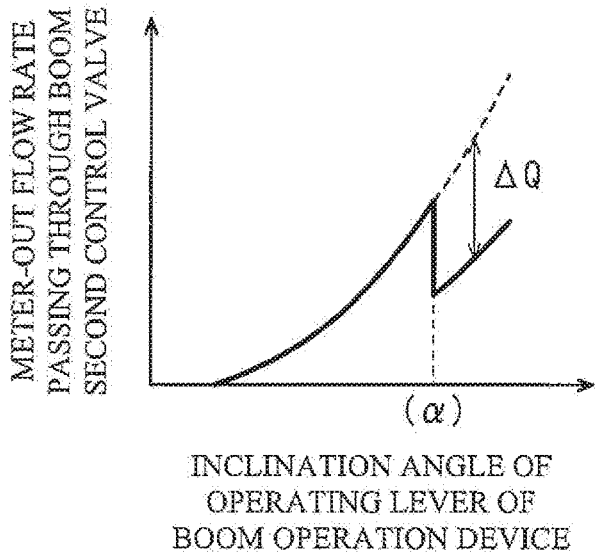
FIGS. 9A to 9C are graphs of Embodiment 2.
Figure 9B:
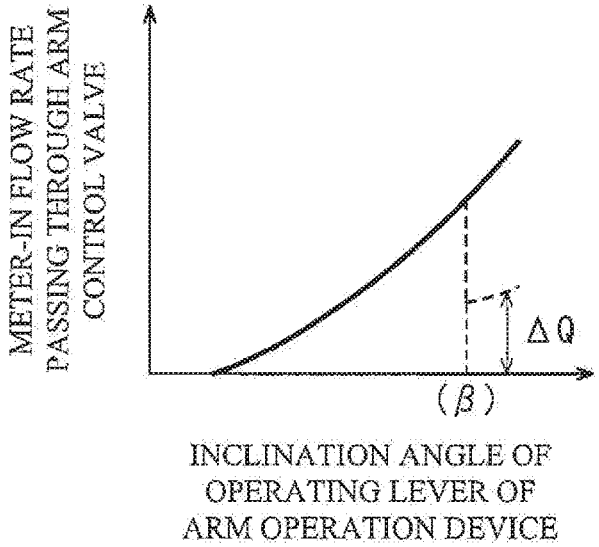
Figure 9C:
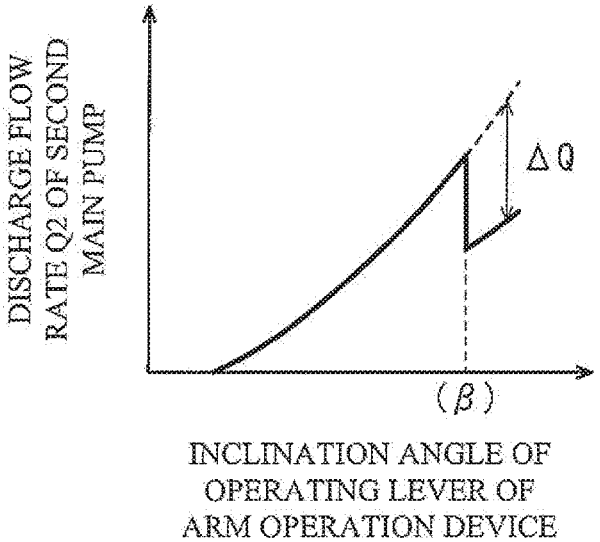

In the present embodiment, compared to a case where the regenerative valve 66 is an on-off valve as in Embodiment 1, the amount of energy that can be regenerated can be increased as shown in FIGS. 9A to 9C.

Embodiment 3

Figure 10:
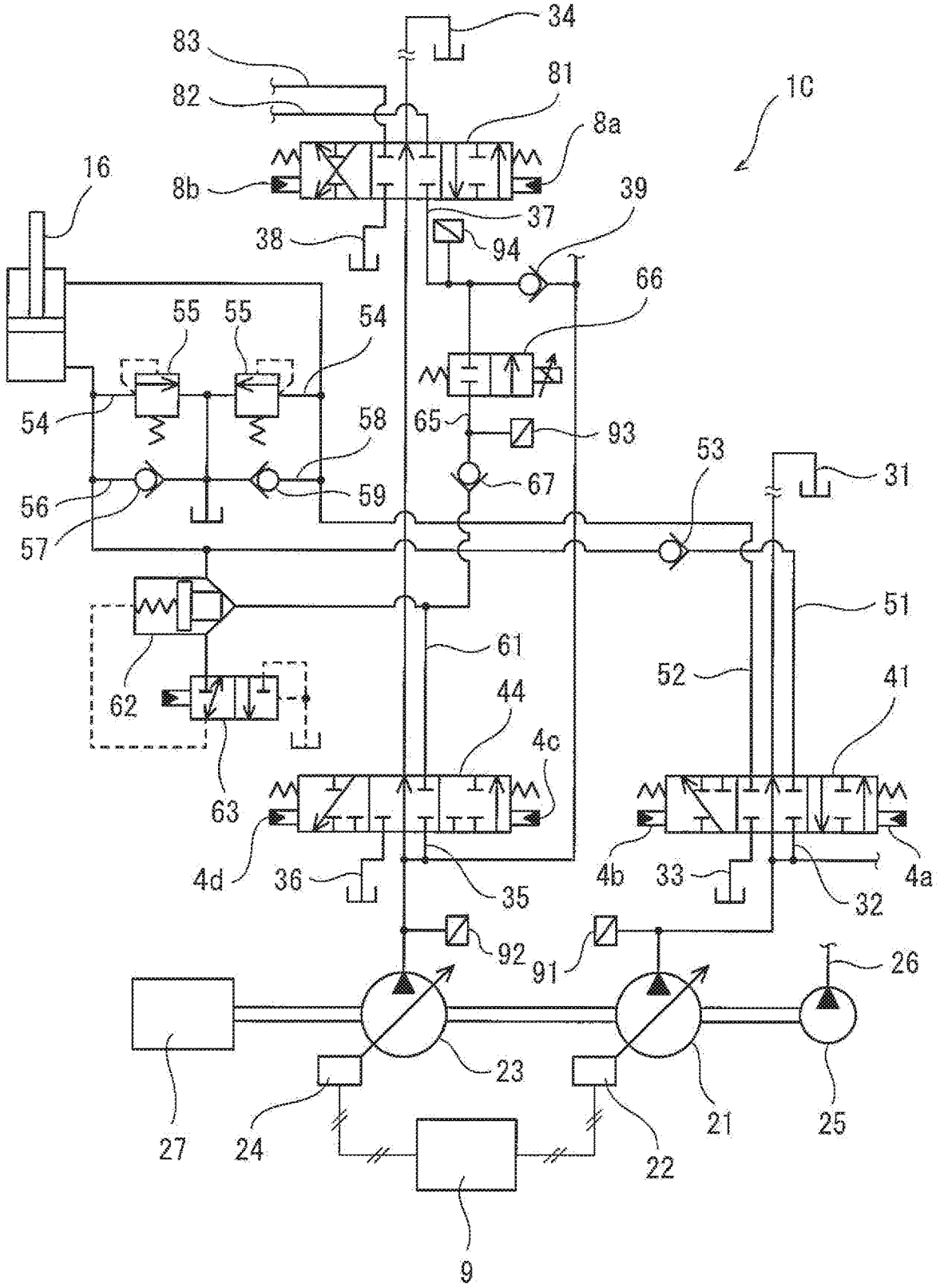
FIG. 10 is a main circuit diagram of a hydraulic excavator drive system according to Embodiment 3 of the present invention.
Figure 11:
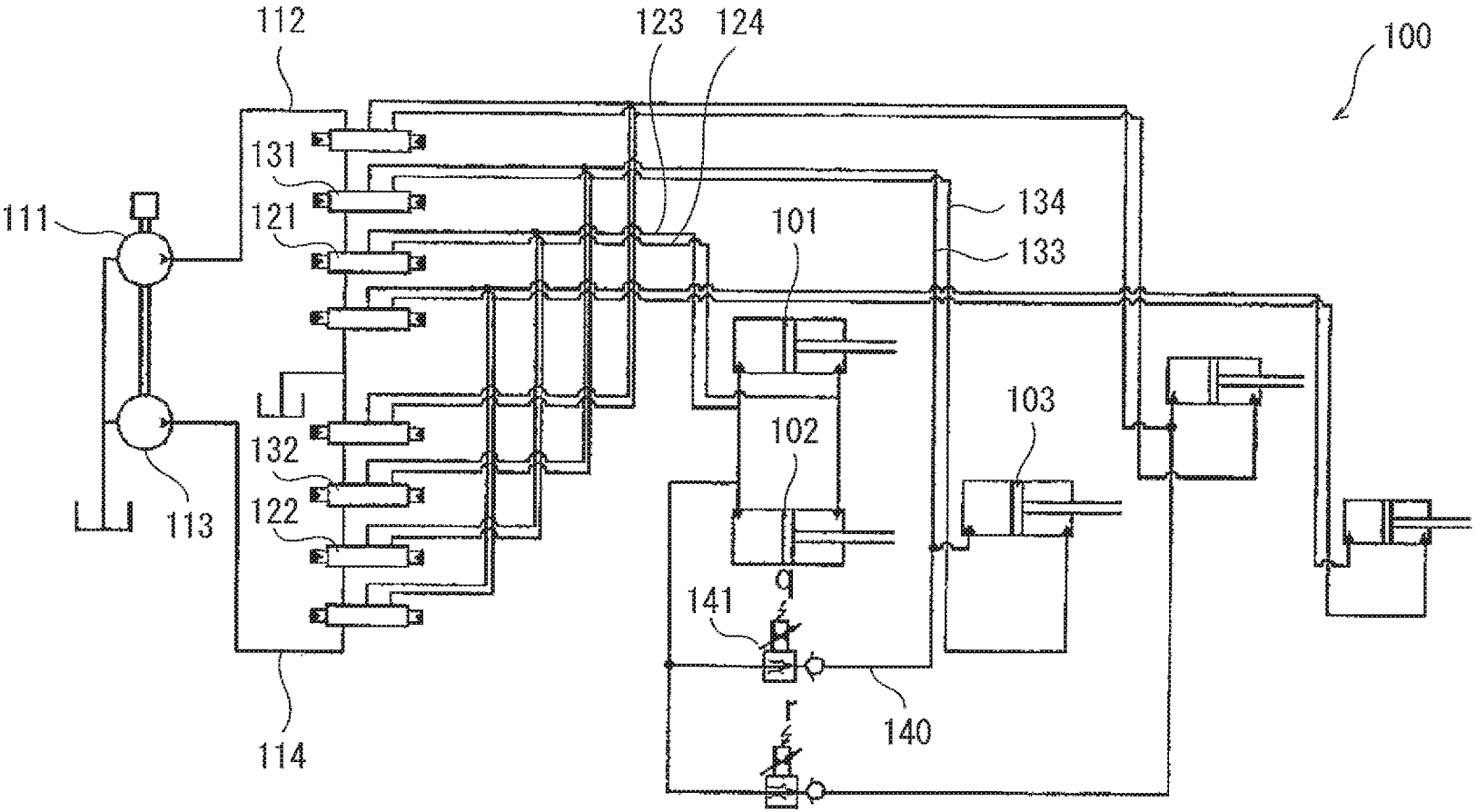
FIG. 11 shows a schematic configuration of a conventional hydraulic excavator drive system.

FIG. 10 shows a hydraulic excavator drive system 1C according to Embodiment 3 of the present invention. The drive system 1C of the present embodiment is different from the drive system 1B of Embodiment 2 in the following point: the drive system 1C adopts a downstream-side pressure sensor 94 in addition to the upstream-side pressure sensor 93. The downstream-side pressure sensor 94 detects a pressure PS2 in the regenerative line 65 at a position that is closer to the arm distribution line 37 than the regenerative valve 66. The upstream-side pressure sensor 93 may be provided on the regenerative line 65 at a position between the regenerative valve 66 and the arm distribution line 37, or may be provided on the arm distribution line 37 at a position between the check valve 39 and the arm control valve 81.

When the regenerative condition is satisfied, the controller 9 adjusts the opening degree A of the regenerative valve 66 based on the pressure PS1 detected by the upstream-side pressure sensor 93 and the pressure PS2 detected by the downstream-side pressure sensor 94. To be specific, the opening degree A of the regenerative valve 66 is adjusted so as to satisfy the following relationship: $A=\Delta Q/c/\sqrt{(PS1-PS2)}$. (Wherein ΔQ is a decrease in the passing flow rate of the boom second control valve 44, and c is a proportionality constant.)

In the present embodiment, the amount of energy that can be regenerated can be increased compared to Embodiment 2.

Other Embodiments

The present invention is not limited to the above-described Embodiments 1 to 3. Various modifications can be made without departing from the spirit of the present invention.

For example, it is not essential that energy regeneration be performed both at the time of arm crowding operation and at the time of arm pushing operation. Energy regeneration may be performed only at the time of arm crowding operation, or only at the time of arm pushing operation.

Each of the boom operation device 47 and the arm operation device 86 may be a pilot operation valve that outputs, as an operation signal, a pilot pressure corresponding to the inclination angle of the operating lever. In this case, the pilot pressure outputted from each of the boom operation device 47 and the arm operation device 86 is detected by a pressure sensor, and the detected pressure is inputted to the controller 9.

REFERENCE SIGNS LIST

1A to 1C hydraulic excavator drive system
10 hydraulic excavator
16 boom cylinder
17 arm cylinder
21 first main pump
22 first flow rate adjuster
23 second main pump
24 second flow rate adjuster
32 first boom distribution line
33 tank line (first tank line)
35 second boom distribution line
36 tank line (second tank line)
37 arm distribution line
41 boom first control valve
44 boom second control valve
45, 46 solenoid proportional valve
47 boom operation device
4*a* to 4*d* pilot port
51 boom raising supply line
52 boom lowering supply line
58 make-up line
59 check valve
61 boom replenishment line
65 regenerative line
66 regenerative valve
67 check valve
81 arm control valve
82 arm crowding supply line
83 arm pushing supply line
86 arm operation device
9 controller
92 second pump pressure sensor
93 upstream-side pressure sensor
94 downstream-side pressure sensor

The invention claimed is:

1. A hydraulic excavator drive system comprising:
a first pump;
a second pump;
a boom cylinder;
a boom first control valve connected to the boom cylinder by a boom raising supply line and a boom lowering supply line, and connected to the first pump by a first boom distribution line, the boom first control valve bringing the boom raising supply line into communication with the first boom distribution line and bringing the boom lowering supply line into communication with a first tank line at a time of boom raising operation, the boom first control valve bringing the boom lowering supply line into communication with the first boom distribution line and blocking the boom raising supply line at a time of boom lowering operation;
a boom second control valve connected to the boom raising supply line by a boom replenishment line, and connected to the second pump by a second boom distribution line, the boom second control valve bringing the boom replenishment line into communication with the second boom distribution line at the time of boom raising operation, the boom second control valve bringing the boom replenishment line into communication with a second tank line at the time of boom lowering operation;
an arm cylinder;
an arm control valve connected to the arm cylinder by an arm crowding supply line and an arm pushing supply line, and connected to the second pump by an arm distribution line in parallel to the boom second control valve;
a regenerative line connecting between the boom replenishment line and the arm distribution line;
an openable and closeable regenerative valve provided on the regenerative line;
a check valve provided on the regenerative line, the check valve allowing a flow from the boom replenishment line toward the arm distribution line and preventing a reverse flow;
a boom operation device including an operating lever that receives a boom raising operation and a boom lowering operation, the boom operation device outputting a boom operation signal corresponding to an inclination angle of the operating lever;
an arm operation device including an operating lever that receives an arm crowding operation and an arm pushing operation, the arm operation device outputting an arm operation signal corresponding to an inclination angle of the operating lever; and
a controller that opens the regenerative valve when a regenerative condition is satisfied, and closes the regenerative valve when the regenerative condition is not satisfied, the regenerative condition being that, in a case where the boom lowering operation is performed concurrently with the arm crowding operation or the arm pushing operation, the boom operation signal outputted from the boom operation device is greater than a first threshold, and the arm operation signal outputted from the arm operation device is greater than a second threshold.

2. The hydraulic excavator drive system according to claim 1, wherein
the second pump is a variable displacement pump,
the hydraulic excavator drive system further comprises a second flow rate adjuster that adjusts a tilting angle of the second pump, and
the controller controls the second flow rate adjuster, such that the tilting angle of the second pump increases in accordance with increase in the arm operation signal outputted from the arm operation device, and when the regenerative condition is satisfied, controls the second flow rate adjuster such that the tilting angle of the second pump, the tilting angle corresponding to the arm operation signal outputted from the arm operation device, is reduced compared to a case where the arm crowding operation or the arm pushing operation is performed alone.

3. The hydraulic excavator drive system according to claim 1, further comprising a solenoid proportional valve connected to a pilot port of the boom second control valve, the pilot port being intended for boom lowering, wherein
the controller controls the solenoid proportional valve, such that an opening area of the boom second control valve increases in accordance with increase in the boom operation signal outputted from the boom operation device, and when the regenerative condition is satisfied, controls the solenoid proportional valve, such that the opening area of the boom second control valve is reduced compared to a case where the boom lowering operation is performed alone.

4. The hydraulic excavator drive system according to claim 1, wherein the regenerative valve is a valve whose opening degree is arbitrarily changeable.

5. The hydraulic excavator drive system according to claim 4, further comprising:

an upstream-side pressure sensor that detects a pressure in the regenerative line at a position that is closer to the boom replenishment line than the regenerative valve; and a second pump pressure sensor that detects a discharge pressure of the second pump, wherein when the regenerative condition is satisfied, the controller adjusts the opening degree of the regenerative valve based on the pressure detected by the upstream-side pressure sensor and the pressure detected by the second pump pressure sensor.

6. The hydraulic excavator drive system according to claim 4, further comprising:

an upstream-side pressure sensor that detects a pressure in the regenerative line at a position that is closer to the boom replenishment line than the regenerative valve; and a downstream-side pressure sensor that detects a pressure in the regenerative line at a position that is closer to the arm distribution line than the regenerative valve, wherein when the regenerative condition is satisfied, the controller adjusts the opening degree of the regenerative valve based on the pressure detected by the upstream-side pressure sensor and the pressure detected by the downstream-side pressure sensor.

7. The hydraulic excavator drive system according to claim 4, wherein the first pump is a variable displacement pump, the hydraulic excavator drive system further comprises:

a first flow rate adjuster that adjusts a tilting angle of the first pump; and a make-up line provided with a check valve, the make-up line connecting between the boom lowering supply line and a tank, and the controller controls the first flow rate adjuster, such that the tilting angle of the first pump increases in accordance with increase in the boom operation signal outputted from the boom operation device, and when the regenerative condition is satisfied, controls the first flow rate adjuster such that the tilting angle of the first pump, the tilting angle corresponding to the boom operation signal outputted from the boom operation device, is reduced compared to a case where the boom lowering operation is performed alone.

* * * * *